US011446715B2

(12) United States Patent
Jacobsen

(10) Patent No.: US 11,446,715 B2
(45) Date of Patent: Sep. 20, 2022

(54) DEVICE FOR REMOVAL OF SEDIMENT FROM INSIDE PILES

(71) Applicant: Jarala AS, Trondheim (NO)

(72) Inventor: Tom Jacobsen, Trondheim (NO)

(73) Assignee: Jarala AS, Trondheim (NO)

( * ) Notice: Subject to any disclaimer, the term of this patent is extended or adjusted under 35 U.S.C. 154(b) by 462 days.

(21) Appl. No.: 16/629,430

(22) PCT Filed: Jul. 10, 2018

(86) PCT No.: PCT/NO2018/050183

§ 371 (c)(1),
(2) Date: Jan. 8, 2020

(87) PCT Pub. No.: WO2019/013646

PCT Pub. Date: Jan. 17, 2019

(65) Prior Publication Data

US 2020/0306803 A1 Oct. 1, 2020

(30) Foreign Application Priority Data

Jul. 10, 2017 (NO) ..... 20171137

(51) Int. Cl.
*E02D 7/24* (2006.01)
*E02D 5/32* (2006.01)
(Continued)

(52) U.S. Cl.
CPC ..... *B08B 9/00* (2013.01); *B08B 1/002* (2013.01); *B08B 7/04* (2013.01); *B08B 13/00* (2013.01);
(Continued)

(58) Field of Classification Search
CPC ..... B08B 9/02; B08B 9/027; B08B 9/032; B08B 9/0321; B08B 9/04; B08B 9/043; B08B 9/0433; B08B 9/045; B08B 1/002; B08B 7/04; B08B 13/00; E02F 3/9262; E02F 3/9268; E02F 5/00
See application file for complete search history.

(56) References Cited

U.S. PATENT DOCUMENTS 9,512,591 B2 12/2016 Spreitzer et al.

FOREIGN PATENT DOCUMENTS

CN 106894416 A 6/2017
EP 2481490 A1 8/2012
(Continued)

OTHER PUBLICATIONS

International Search Report and Written Opinion dated Sep. 17, 2018 (PCT/NO2018/050183).

*Primary Examiner* — Tara Mayo-Pinnock
(74) *Attorney, Agent, or Firm* — Alix, Yale & Ristas, LLP

(57) ABSTRACT

Device for removal of sediment from inside piles being at least partly immersed in water, comprising an outer guiding unit arranged to be temporarily positioned on the top of a pile. The outer guiding unit envelopes at least one inner dredging unit being arranged to be lowered from within the outer guiding unit, the inner dredging unit at its lower end exhibiting movable jet nozzles arranged to loosen sediment. The inner dredging unit furthermore comprises a central passage which is connected to a discharge hose arranged to transport loosened sediment therefrom.

20 Claims, 4 Drawing Sheets

(51) Int. Cl.

| | |
|---|---|
| ***E02D 13/08*** | (2006.01) |
| ***E02F 3/92*** | (2006.01) |
| ***B08B 9/032*** | (2006.01) |
| ***B08B 9/00*** | (2006.01) |
| ***B08B 1/00*** | (2006.01) |
| ***B08B 7/04*** | (2006.01) |
| ***B08B 13/00*** | (2006.01) |
| ***E02F 5/00*** | (2006.01) |

(52) U.S. Cl.
CPC ..... *E02F 3/9262* (2013.01); *E02F 3/9268* (2013.01); *E02F 5/00* (2013.01)

(56) References Cited

FOREIGN PATENT DOCUMENTS

| | | | | |
|---|---|---|---|---|
| GB | 282820 | | 8/1928 | |
| JP | 2003181402 | A | 7/2003 | |
| NL | 8200866 | A | 10/1983 | |
| WO | 03056107 | A1 | 7/2003 | |
| WO | WO-2016154394 | A1 * | 9/2016 | ..... B08B 7/0064 |

* cited by examiner

DEVICE FOR REMOVAL OF SEDIMENT FROM INSIDE PILES

BACKGROUND

The disclosed embodiments concern a device for removal of sediment from inside piles and the like.

Piles struck into the sea floor is commonly used as fundament e.g. for platforms, docks, or other installations. Such piles are typically made of metal and are necessarily hollow due to their dimensions and for allowing them to be struck into the seafloor. The diameter of such piles varies within wide limits from a few tenths of centimetres up to several meters.

It is oftentimes a need to have access to the inside of such piles, e.g. if the pile is to be removed or to be able to attach anchoring devices. Therefore, there is oftentimes a need to clean the inner wall thereof.

A number of devices for dredging sediment from the seafloor have been proposed, hereunder devices making use of conventional centrifugal pumps as well as ejectors for providing suction force.

No device is known that is well suited for dredging in so limited areas as inside piles and in particular devices which enable a simultaneous cleaning/washing of wall surfaces in such restricted cavities.

A device in the form of a suction had is known from applicant's own WO 03056107, where suction is presumed to be established by means of a device arranged at a distance from the suction head, in connection to an outlet conduit from the suction head. It is also priory described to establish suction for similar purposes.

EP 2 481 490 A1 describes a device for removal of sediment from the inside of piles which are wholly or partially submerged in water. In one embodiment the device comprises a frame which is adapted to rest against the top of a pile and a unit below the frame provided with movable flushing nozzles. The device furthermore has a central passage for discharging released sediment.

Among other publication within this field, Netherland's patent application No. NL 82 00 866 A from 1982 and British patent application No. GB 282 820 from 1927 are mentioned.

Suction devices which may be operated from a crane or winch on a vessel and which may be lowered into a pile for suction of sediment therefrom are also known in the art.

SUMMARY

It would be useful to provide a device to remove sediment, also cohesive, fine and coarse sediment with some larger particles from narrow subsea cavities, such as within piles but also from other subsea cavities, typically cavities with a mainly uniform or constant cross-section from top to bottom. This is also the case for piles placed at significant depths. In order to obtain the desired effect the device should be robust and endure being lowered into such cavities without being damaged. It should furthermore be versatile in use, hereunder be useful in piles of different diameters. It should still maintain capacity and operational reliability even if the visibility or maneuverability in the cavity is impaired. The equipment should be operable as an assembly from being launched until being retrieved. The equipment should be operable also in bad weather with high waves, independent of position and movement of the vessel from which the device is launched. It is furthermore preferred that the equipment is able to remove all sorts of masses, from cohesive clays to gravel and larger rocks as efficiently as possible and without blocking discharge conduits and hoses. It is furthermore an objective that the resulting surface at the bottom of the pile is as even as possible, so that a minimum of cement is required in the possible case that a construction is to be casted within the pile.

The term "piles", as used herein, means any kind of piles used for subsea piling as well as similar subsea structures comprising vertically oriented cavities with mainly circular cross-section.

The disclosed embodiments allow removal of sediment from cavities and in particular from the inside of piles, even at significant depths, much simpler and faster than before. In addition, this may be performed with a high degree of operational reliability and efficiency. Furthermore, sediment of different types, such as sand, gravel, hard clay and particles up to the size of inlet opening the may be removed. The disclosed device can be charged by a pump arranged at the sea floor near the pile, by a pump being connected to and an integrated part of the device or by a pump localized above the water surface. All flexible hoses are arranged with an overpressure and are of a robust type which can easily be handled during launching and retrieval.

The disclosed device allows sediment to be removed from the pile without the device being suspended from a crane or boat winch. The operation can thus be performed without a vessel being maintained in a fixed position.

The outer guiding unit can envelop the inner dredging unit which is provided with one or more pivotal feet as discussed below, e.g. a number of two, three, four or six. The structure becomes more complicated with plural feet per dredging unit but on the other hand the feet may then be smaller and it becomes easier to obtain the required strength for these units.

The movable nozzles may be commonly movable by being mounted on a pivotal foot, but may also be individually movable, for example so that they repeatedly and linearly commute between two turning points while the water jet draws a line on the surface below, or rotating so that the water jet draws a circle on the surface below. A combination of nozzles being individually movable and mounted on a pivotal foot allow drawing of lines on the surface which over time cover any point of the surface below.

The nozzles may optionally be movable by turning the entire dredging unit in relation to the guiding unit.

A pivotal foot can be movable in a back and forth direction within a defined angular range between the turning points, e.g. an angular range of 15-180 degrees. Such restricted pivotability makes it easy to provide liquid to the nozzles, since this may be done by means of flexible hoses. A pivotal foot can also be continuously pivotal in one and the same direction.

In addition to loosening sediment by means of nozzles and water jets, teeth may be used to mechanically scrape sediment free within the pile. In addition to the direct effect thereof, the additional effect is obtained, by arranging the teeth in a convenient manner, that the teeth function as spacers that prevent the nozzles from directly contacting the surface and thereby reduces wear and tear. Teeth may be mounted on the same foot as the nozzles or on a separate foot.

BRIEF DESCRIPTION OF THE DRAWINGS

Below, the present invention is described in further detail in the form of non-limiting exemplary embodiments, with reference to the enclosed drawings.

Figure 1A:
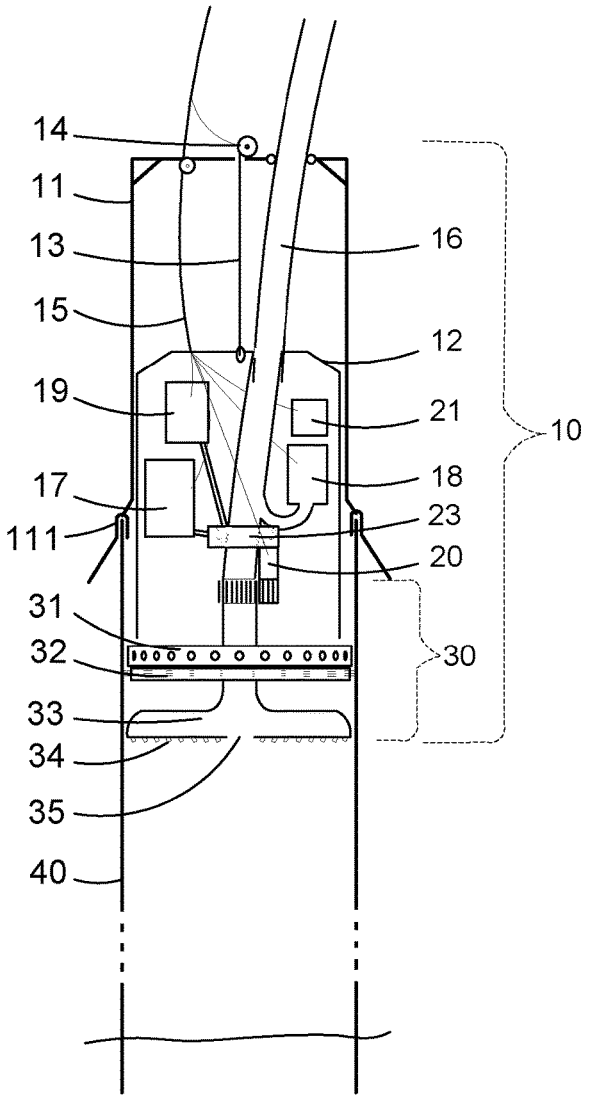
FIG. 1A is a schematic side sectional view of an embodiment of a device according to the disclosure.
Figure 1B:
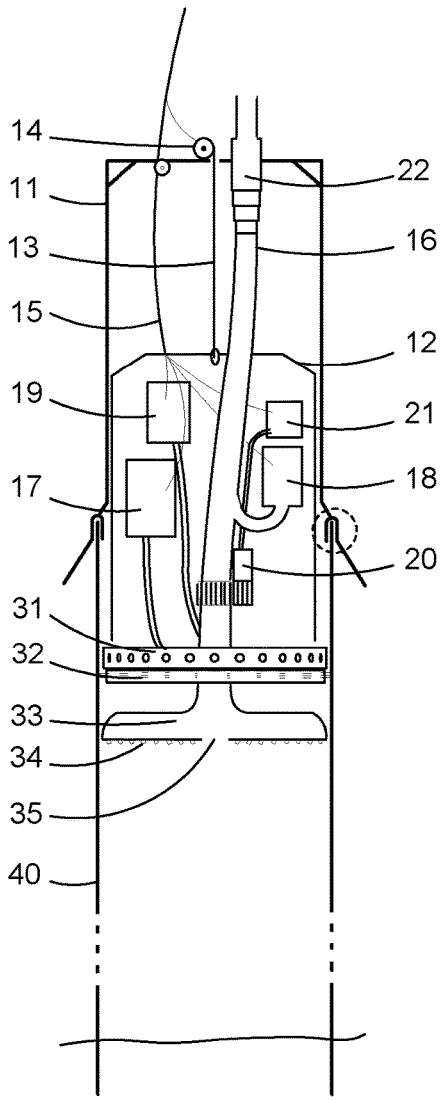
FIG. 1B is a schematic side sectional view of a variant of the embodiment shown in FIG. 1A.

The FIGS. 2A-2D show different variants of a detail shown in the FIGS. 1A and 1B.

Figure 3:
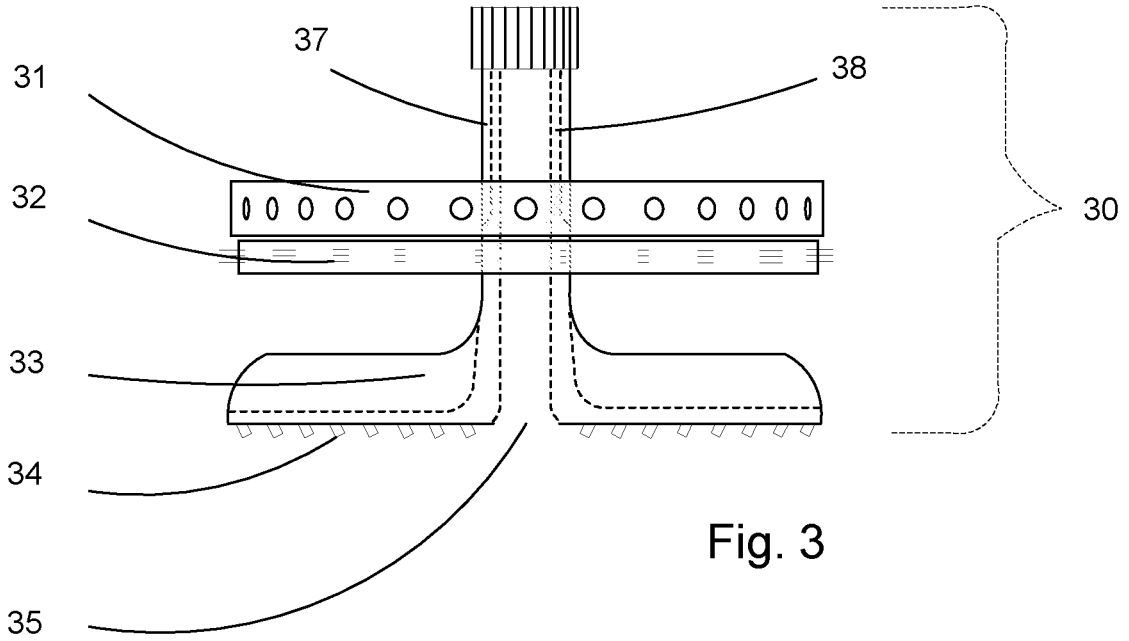

FIG. 3 shows enlarged a detail of a preferred embodiment of the disclosed device.

Figure 4:
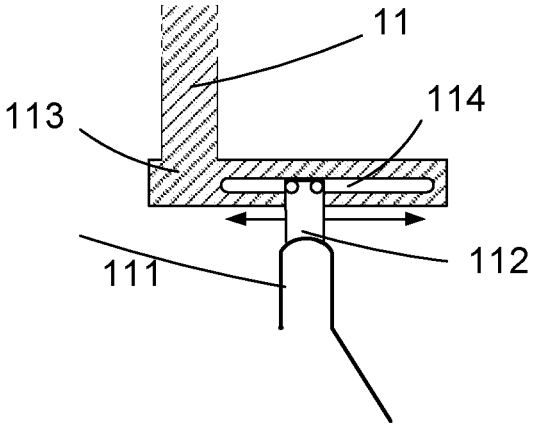

FIG. 4 shows enlarged another detail of a preferred embodiment of the disclosed device.

Figure 5:
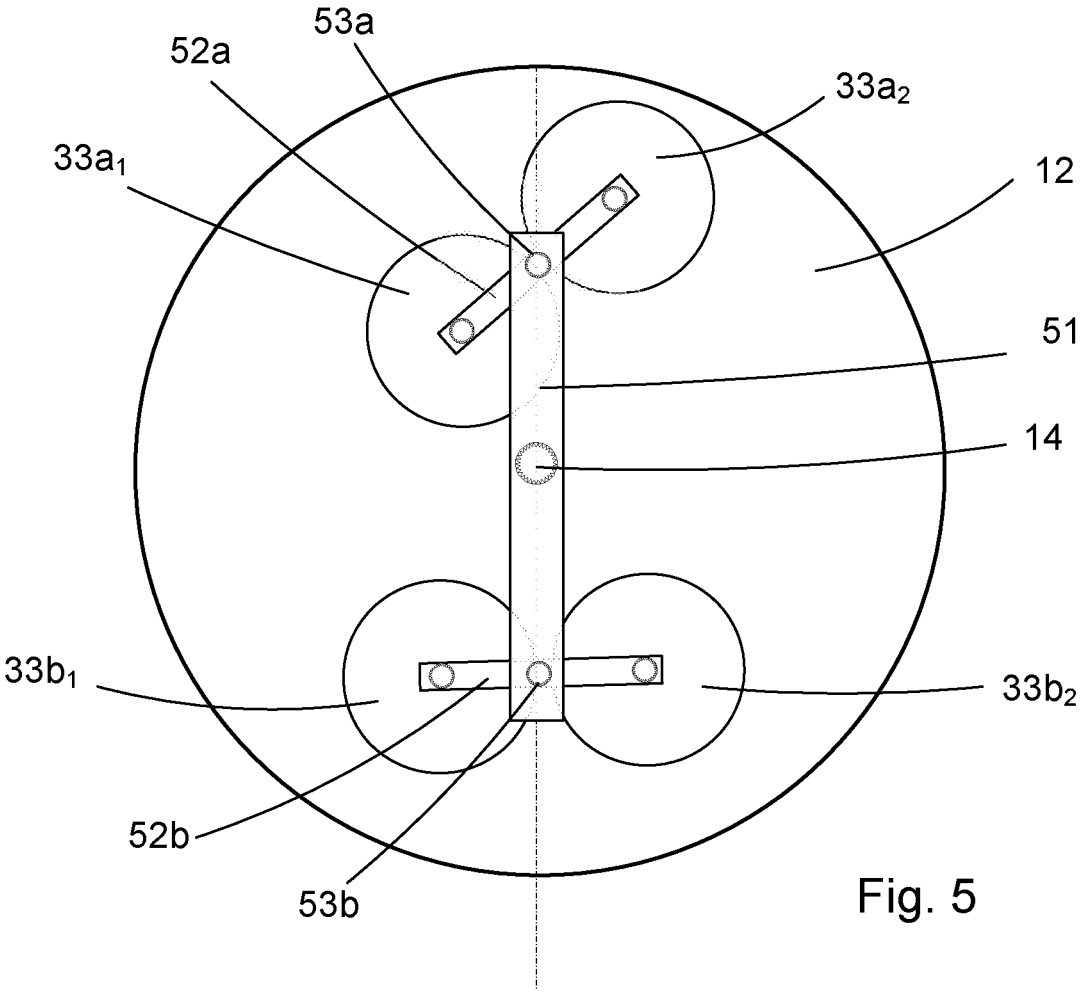

FIG. 5 shows an alternative embodiment of the disclosed device, comprising a plurality of pivotal feet below a dredging unit.

DETAILED DESCRIPTION

It should be emphasized that the drawings are simple principle drawings which do not necessarily show correct proportions between different elements or the mutual position of elements which are optimal in a practical embodiment.

FIG. 1A shows a cross-section through central parts of a device 10. It is worth noting that the drawing is schematic and that material of a certain thickness is shown just as a simple line.

The device 10 comprises an outer guiding unit 11 with a diameter adapted to the diameter of a pile 40 from which dredging is to be performed and with an attachment member 111 suited to be received on top of the pile 40, steadily resting on top of the pile. The attachment can be of different configurations and may as an example have an area shaped as an inverted "U", suitable for enveloping the upper end of the pile and an area which forms a conical skirt, contributing to centre the device on the pile. It is not necessarily any kind of locking mechanism between the guiding unit to the pile in question.

Furthermore, the device 10 comprises an inner dredging unit 12 which is suspended from the outer guiding unit 11 with a wire 13 which can be shortened or extended by means of a winch 14 suitable for subsea operation. Alternatively, a hydraulic cylinder or a pitch rack can be used to raise and lower the inner dredging unit 12.

The device has a power supply 15 at the surface. Units which can be operated with electric current comprises a water puma 17 for providing water to the different nozzles which are described in further detail below, an ejector pump 18 arranged to pump out released material through a discharge hose 16, optionally an ultra-high pressure for supplying water at extremely high pressure to jet nozzles, a motor 18 arranged to turn a pivotal lower part 30 of the device 10 and optionally an hydraulic aggregate 21. A high-pressure or ultra-high pressure pump can provide water at a pressure of more than 100 bar, preferably more than 200 bar, typically from 500 to 2000 bar.

The pivotal part 30 of the dredging unit 12 comprises a foot 33 with jet nozzles 34 receiving water from the pump 17, alternatively from the high pressure pump 19. At the centre of the foot 33 there is an opening with communicates with the outlet 16 and which, during operation, exhibits a sub-pressure generated by the ejector pump 18. The jet nozzles 34 can have different orientations but it is preferred that at least some of them are directed towards the centre to move released sediment inwards to the centre opening 35. Even if the jet nozzles 34 in FIG. 1A is shown as apparently unprotected from mechanical influence from below, there are in practice a number of ways available for protecting the nozzles. They may for example be arranged within recessed areas at the underside of the foot 33 so that they will not easily come into direct contact with sediments, or one might arrange protrusions or teeth between the nozzles with a downward vertical extension exceeding the vertical extension of the nozzles.

Above the foot 18 typically a circular disc 31 with cleaning nozzles is arranged and also a circular disc 32 provided with brushes along its periphery. Both mentioned discs 31 and 32 and the foot 33 will be rotated by the motor 20 when it is operated. More than one disc provided with cleaning nozzles may be provided and also more than one brushing disc 32, for example a brushing disc 32 over a disc 31 with cleaning nozzles and a brushing disc 32 below said disc 31 with cleaning nozzles. Alternatively, brushes may be applied with different types of brushing material on different brushing discs or even different types of brushing material along the periphery of one and the same brushing disc.

The cleaning nozzles on the disc 31 can be supplied with water from a pump 17 providing a lower pressure than the pressure of the water supplied to the jet nozzles 34 under the foot 33.

In FIG. 1A a supply pipe for water from the pumps 17 and 19 to a manifold 23 enveloping discharge hose 16 is shown. From the manifold concentric, ring shaped channels (not shown) for water are arranged down to the pivotal foot, as explained in further detail with reference to FIG. 3. This design allows a full rotation of the pivotal foot 33.

The discharge hose 16 must be arranged unhindered through an opening at the top of the outer guiding unit 11 or include a telescopically extendable part allowing the inner dredging unit 12 to move up and down in relation to the outer guiding unit 11 without being subjected to tension or bending. Same applies for the current supply 15 which for example can include a reel at the top of the outer guiding unit 11.

The power demanding units of the inner dredging unit may all be operated with electric power, but one or more may also be powered hydraulically.

FIG. 1B shows generally the same as FIG. 1A but with the following differences. The discharge pipe or hose 16 is in FIG. 1B shown with a telescopic joint 22 at the opening through the outer guiding unit 11. Furthermore, the motor 20 is shown as hydraulically powered from the hydraulic aggregate 21 rather than being electrically powered.

Furthermore, in FIG. 1B shows flexible hoses from the pumps 17 and 19 to the pivotal disc 31 and the base of the foot 33 respectively. This design may be used when the pivotal foot 33 is arranged to turn back and forth within a limited angular range.

At its lower end, the outer guiding unit exhibits at least one attachment member suitable for being attached to the top of a hollow pile. It may have the shape of an inverted "U" profile which run circularly around the entire lower edge of the guiding unit 11. It may also have the shape of shorter profiles suitable for surrounding smaller parts of the top of an open cylinder structure, such as a pile; e.g. three profiles, mutually separated by angles of 120 degrees along a real or imaginary circular periphery at the lower end of the guiding unit. Alternatively, such shorter profiles may be radially displaceable in order to be adapted to piles of varying diameters.

Figure 2A:
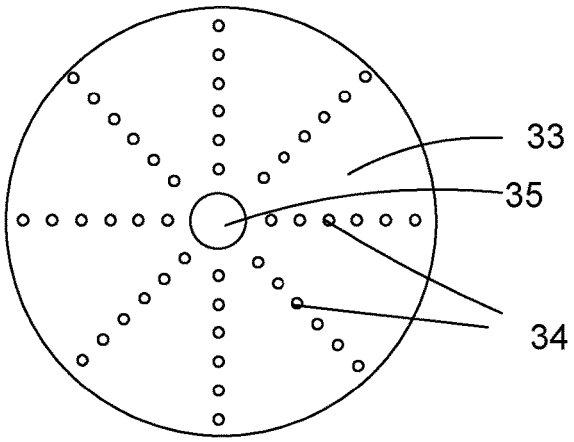
Figure 2B:
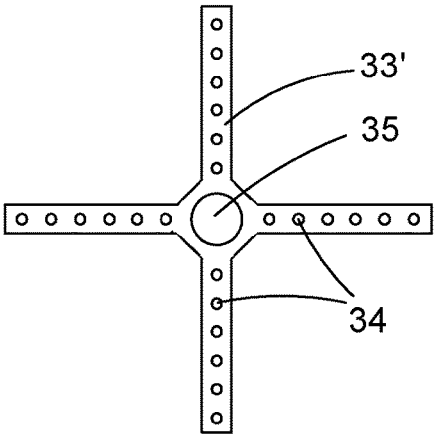
Figure 2C:
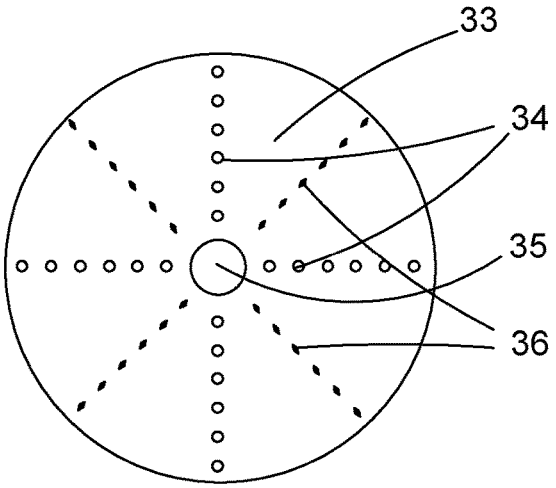

FIG. 2A-2C show different variants of the foot 33 seen from below. In FIG. 2A the foot 33 has the shape of a complete disc with eight radially arranged rows of nozzles from the disc centre. The orientation of the nozzles can vary (not shown), for example such that some nozzles are tangentially directed while others are directed towards the centre.

FIG. 2B shows an embodiment in which the foot 33' has the shape of a cross with four arms extending laterally out from a pivotal centre. The nozzles 34 can be of same type and orientation as for the version shown in FIG. 2A. A variant of the shown embodiment has curved arms and/or a number of arms different from four.

FIG. 2C shows an embodiment in which the foot 33 has the same shape as in FIG. 2A but where there are four radial rows of nozzles and four intermediate rows 36 of teeth to mechanically belabour the mass to be released inside the pile.

Figure 2D:
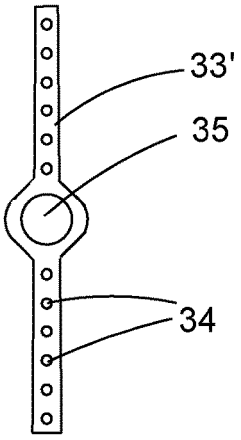

FIG. 2D shows an embodiment not unlike the one of FIG. 2B but with two extending arms rather than four.

Also in the case of embodiments comprising a circular disc, the nozzles and teeth, if present, may be arranged along curved lines as well as straight lines.

FIG. 3 shows enlarged the pivotal parts of the device 10. FIG. 3 illustrates the fact that the mandrel carrying the cleaning disc 31, the brushing disc 32 and the foot 33 can contain ring shaped concentric channels 37, 38 for supplying water from the water pump 17 and optionally from an ultrahigh-pressure pump 19 to the corresponding nozzles. An outer ring shaped channel 37 is connected to the nozzles on the cleaning disc 37 while an inner ring shaped channel 38 is connected to the nozzles 34 under the foot 33. Within the inner rig shaped channel 38 the outlet passage for fluid connection to the discharge hose 16 is arranged.

FIG. 4 shows a cross-section of the lower part of the outer guiding unit 11 and how it is arranged to allow it to be attached to the top of piles with different diameters. An attachment member 111 is shown attached to the lower part of outer guiding unit via a strut 112 being hinged to a radial intermediate piece 113 and in a longitudinally extending groove 114 therein. The intermediate piece 113 is radially arranged in relation to the outer guiding unit 11 and thereby in relation to any pile to be dredged and to which the guiding unit is going to be attached. The strut 112 can conveniently be locked at the desired position in the groove 114 when the diameter of the pile or piles in question is known, e.g. by means of a nut or any suitable quick-lock mechanism.

FIG. 5 shows an embodiment where a total number of four pivotal feet 33$a_1$, 33$a_2$, 33$b_1$ and 33$b_2$ are suspended from a dredging unit 12. The units are divided between two stations, a station 33*a* uppermost in FIG. 4 and a station 33*b* lowermost in the Figure. The two stations are suspended from each separate end of primary transversal beam 51 which can be raised and lowered by a central winch 14. The transversal beam 51 can rotate about its suspension point at the winch 14. The feet 33$a_1$, 33$a_2$ are suspended from a secondary transversal beam 52*a* which in turn is pivotally suspended from the primary transversal beam 51 at a point 53*a*. In a corresponding manner the feet 33$b_1$ and 33$b_2$ are suspended from a secondary transversal beam 52*b* which in turn is pivotally suspended from the primary transversal beam at a point 53*b*, the point 53*a* and 53*b* being located near opposite ends of the primary transversal beam 51. By "pivotally suspended" is understood that pivotal motion or full rotation can be enforced by means of a suitable motor. During pivotal motion of the primary transversal beam as well as both the secondary transversal beams 52*a* and 52*bm* the four feet as a whole will be able to cover each and any point of the surface within the cylinder wall of the dredging unit 12, which mainly corresponds to the cross-section of the pile. It is hereunder a presumption that the diameter of each of the four feet is about ¼ of the diameter of the dredging unit and that the suspension points are arranged in manner preventing the feet from colliding with one another even if their motion is not mutually coordinated.

The four feet may or may not be identically equipped with regard to nozzles and, optionally, teeth. For example, one foot in each station can be equipped with nozzles only and the other one with teeth only.

The device can be equipped with separate nozzles, arranged on the foot or over the foot, which are laterally directed and arranged to be supplied with water of ultrahigh pressure and which is suitable for removing rust, concrete and fouling.

The invention claimed is:

1. A device (10) for removal of sediment from inside piles (40) which are at least partially immersed in water, comprising an outer guiding unit (11) adapted for temporary positioning on top of a pile, at least one inner dredging unit (12) enveloped by the outer guiding unit and configured to be lowered from the outer guiding unit (11), wherein the inner dredging unit (12) has a lower end comprising movable jet nozzles (34) arranged to loosen sediment, and the dredging unit (12) comprises a central passage (35) in communication with a discharge hose (16) arranged to transport loosened sediment therefrom.

2. The device (10) as claimed in claim 1, wherein the outer guiding unit has a lower end with at least one attachment member (111) configured for attaching a hollow pile top.

3. The device (10) as claimed in claim 1, comprising at least one foot (33) on which the movable jet nozzles (34) are arranged, wherein movement of the nozzles (34) is provided by one or more from the group consisting of:

i) nozzles being movable in relation to the foot (33), ii) the foot (33) being at least partly pivotal, and iii) the dredging unit (12) being pivotal in relation to the guiding unit (11).

4. The device (10) as claimed in claim 3, wherein the inner dredging unit (12) is configured to be moved vertically up and down independent from the operation of the nozzles (34).

5. The device (10) as claimed in claim 3, wherein the foot (33) is configured to be rotated either continuously in one rotational direction or to be rotated back and forth within a predetermined angular path.

6. The device (10) as claimed in claim 1, wherein water to the nozzles (34) is charged through swivels or flexible hoses.

7. The device (10) as claimed in claim 1, wherein the jet nozzles (34) receive water from at least one water pump (17, 19) in the inner dredging unit (12).

8. The device (10) as claimed in claim 3, wherein the foot (33) has a cross-section that is either a circular disc or plurality of extending arms.

9. The device (10) as claimed in claim 3, wherein the dredging unit (12) includes teeth (36) configured to mechanically loosen sediment.

10. The device (10) as claimed in claim 9, wherein the teeth (36) are moveable by being attached to a pivotal foot (33).

11. The device (10) as claimed in claim 1, comprising a source of at least one of electric energy and hydraulic energy.

12. The device (10) as claimed in claim 1, wherein the inner dredging unit (12) comprises an ejector pump (18) for inducing a suction force in the discharge hose (16).

13. The device (10) as claimed in claim 1, comprising a water pump (17), wherein the inner dredging unit (12) comprises lateral cleaning nozzles for receiving water from the water pump (17).

14. The device (10) as claimed in claim 2, comprising a rotatable part (30) that includes the foot (33) and a cleaning disc (31) provided with lateral cleaning nozzles that receive water from a water pump (17).

15. The device (10) as claimed in claim 14, wherein the rotatable part (30) comprises brushes arranged to brush internal walls of a pile (40).

16. The device (10) as claimed in claim 7, wherein the inner dredging unit (12) comprises a high-pressure or ultra-high-pressure pump (19) configured to provide water to separate jet nozzles (34) at a pressure greater than that provided by the water pump (17), wherein the pressure provided by the high-pressure or ultrahigh-pressure pump (19) is greater than 100 bar.

17. The device (10) as claimed in claim 3, wherein the pivotal foot (33) is turned by a motor (20) that is powered either electrically or hydraulically.

18. The device (10) as claimed in claim 1, wherein the inner dredging unit (12) is configured to be lowered from the outer guiding unit (11) by a device selected from the group consisting of a winch (14) and a wire (14), a pitch rack and a hydraulic cylinder.

19. The device (10) as claimed in claim 1, wherein the inner dredging unit (12) includes hydraulic cutting equipment that is either permanently attached or detachable.

20. The device (10) as claimed in claim 1, wherein the inner dredging unit (12) is configured to connect to additional tools for performing work within the pile (40) and on a wall of the pile (40).

* * * * *